US006735883B1

(12) United States Patent
Bria et al.

(10) Patent No.: US 6,735,883 B1
(45) Date of Patent: May 18, 2004

(54) ELECTROSTATIC ASSISTED WEB COOLING AND REMOISTENING DEVICE

(75) Inventors: Michael P. Bria, Green Bay, WI (US); Ed Salmon, Sobieski, WI (US); David J. Welter, Chargrin Falls, OH (US); David M. Klein, Fontana, WI (US); Steven J. Siler, Lake Geneva, WI (US)

(73) Assignees: Megtec Systems, Inc., DePere, WI (US); Hurletron, Inc., Libertyville, IL (US)

( * ) Notice: Subject to any disclaimer, the term of this patent is extended or adjusted under 35 U.S.C. 154(b) by 0 days.

(21) Appl. No.: 10/110,142

(22) PCT Filed: Oct. 11, 2000

(86) PCT No.: PCT/US00/28062

§ 371 (c)(1),
(2), (4) Date: Jul. 15, 2002

(87) PCT Pub. No.: WO01/28777

PCT Pub. Date: Apr. 26, 2001

Related U.S. Application Data

(60) Provisional application No. 60/159,840, filed on Oct. 15, 1999.

(51) Int. Cl.[7] ..... F26B 3/00

(52) U.S. Cl. ..... 34/444; 34/446; 34/526; 34/611; 34/254; 101/424.1; 101/487

(58) Field of Search ..... 34/444, 423, 428, 34/446, 119, 254, 526, 611, 510, 124; 101/92, 219, 488, 424.1, 487

(56) References Cited

U.S. PATENT DOCUMENTS

| | | | | |
|---|---|---|---|---|
| 3,467,541 A | | 9/1969 | Aronsson et al. | 117/93.4 |
| RE26,951 E | | 9/1970 | Vaccaro | 118/6 |
| 3,823,488 A | | 7/1974 | Houben et al. | 34/156 |
| 4,207,143 A | | 6/1980 | Glomb et al. | 162/207 |
| 4,689,895 A | | 9/1987 | Taylor et al. | 321/20 |
| 4,702,015 A | | 10/1987 | Taylor et al. | 34/20 |
| 4,763,424 A | | 8/1988 | Taylor et al. | 34/20 |
| 5,070,628 A | | 12/1991 | Zagar | 34/156 |
| 5,508,064 A | | 4/1996 | Naruse | 427/421 |
| 5,548,907 A | | 8/1996 | Gourdine | 34/448 |
| 5,642,671 A | | 7/1997 | Winheim | 101/424.1 |
| 5,669,158 A | * | 9/1997 | Murray et al. | 34/393 |
| 5,881,647 A | | 3/1999 | Siler et al. | 101/488 |
| 6,076,466 A | * | 6/2000 | Siler et al. | 101/488 |
| 6,223,448 B1 | | 5/2001 | Motzke et al. | 34/61 |

* cited by examiner

*Primary Examiner*—Ehud Gartenberg
*Assistant Examiner*—Camtu Nguyen
(74) *Attorney, Agent, or Firm*—Mitchell D. Bittman; Kevin S. Lemack

(57) ABSTRACT

Apparatus and a method for enhancing the effectiveness of a water spray (30) to cool and/or remoisten a web (12) of material. The apparatus includes a web dryer, preferably a flotation dryer (100), an electrostatic charge generating device (31) or devices, a water spray (30), an integrated power supply (20) to supply high voltage power to the charge device, and a drainage system (35) for handling excess liquid generated during the cooling and/or remoistening of the web. The cooling apparatus is capable of a modular arrangement to optimize spacing and facilitate the addition of cooling capacity where needed, such as with faster web speeds or heavier web weights. One or more temperature sensors can be used to optimize the amount of and rate of fluid fed to the spray nozzles. The spray nozzles and charge bars can be retractable with respect to the web to facilitate web-up procedures.

14 Claims, 12 Drawing Sheets

ELECTROSTATIC ASSISTED WEB COOLING AND REMOISTENING DEVICE

This application is a 371 of PCT/US00/28062 filed Oct. 11, 2000, which claims benefit of Ser. No. 60/159,840 filed Oct. 15, 1999.

BACKGROUND OF THE INVENTION

The present invention relates to apparatus for cooling and/or remoistening of a moving web. In drying a moving web of material, such as paper, film or other sheet material, it is often desirable that the web be contactlessly supported during the drying operation in order to avoid damage to the web itself or to any ink or coating on the web surface. A conventional arrangement for contactlessly supporting and drying a moving web includes upper and lower sets of air bars extending along a substantially horizontal stretch of the web. Heated air issuing from the air bars floatingly supports the web and expedites web drying. The air bar array is typically inside a dryer housing which can be maintained at a slightly sub-atmospheric pressure by an exhaust blower that draws off the volatiles emanating from the web as a result of the drying of the ink thereon, for example.

It is often necessary to cool and/or remoisten the web after it has been dried. For example, U.S. Pat. No. 5,333,395 discloses a drying apparatus for traveling webs which includes a cooling tunnel directly connected with the dryer, a combustion chamber for combusting solvent which becomes volatile during drying of the web, heat exchangers, etc. U.S. Pat. No. 5,038,495 discloses a cooling device for cooling a web of material exiting a dryer. The cooling device comprises a substantially closed housing with an inlet and an outlet slit for the web of material. The housing includes a feed aperture at the outlet slit side for feeding outside air into the housing, and a discharge aperture at the inlet slit side for discharging air from the housing into the dryer. Air is fed through the housing counterflow to the direction of web travel. A series of nozzles bring the infed air into contact with the web of material. U.S. Pat. Nos. 4,702,015, 4,689,895 and 4,763,424 disclose apparatus and a method for providing a shower of fog onto a web or machine component in contact with the web. The fog evaporates on the hotter surface and cools that surface. U.S. Pat. No. 5,881,647 discloses the use of electrostatic fields to direct a water spray towards a web.

Smoke tunnels are conveniently used in web dryers to address the generation of smoke during processing. Smoke tunnels are typically located between the flotation dryer and the chill stand. More efficient handling of the web as it exits the dryer would be desirable.

It therefore would be desirable to lower the bulk temperature of the web in order to decrease the heat load of the cooling or chill rolls, or even eliminate the chill rolls or other cooling means such as an air-based cooling zone. Lowered web bulk temperature also would decrease the evaporation rate of the solvent mixture coating the web, thereby reducing the visible vapors evolving from the web and eliminating the need for a smoke tunnel. Condensation that normally occurs at the dryer exit and on the cooling rolls could be controlled to a minimum, and the product quality of the web could be improved in view of the absence of excessive moisture loss from the web.

SUMMARY OF THE INVENTION

The problems of the prior art have been overcome by the present invention, which provides apparatus and a method for enhancing the effectiveness of a water spray to cool and/or remoisten a web of material. More specifically, the preferred embodiment of the apparatus in accordance with the present invention includes a web dryer, preferably a flotation dryer, an electrostatic charge generating device or devices, a water spray, an integrated power supply to supply high voltage power to the charge device, and a drainage system for handling excess liquid generated during the cooling and/or remoistening of the web. The cooling apparatus is capable of a modular arrangement to optimize spacing and facilitate the addition of cooling capacity where needed, such as with faster web speeds or heavier web weights. One or more temperature sensors can be used to optimize the amount of and rate of fluid fed to the spray nozzles. The spray nozzles and charge bars can be retractable with respect to the web to facilitate web up procedures.

In its method aspects, the present invention is directed towards a method for drying and cooling a web, typically a moving web, by heating the web such as with a plurality of air flotation nozzles, and enhancing the effectiveness of a water spray by directing the water spray onto the web, by controlling the amount of water sprayed onto the web based upon the web temperature, by removing excess liquid generated during the cooling and/or remoistening process, and by removing steam generated by the cooling process.

The present invention thus reduces or eliminates dryer smoking from the dryer exit end without the use of a conventional smoke tunnel, reduces or eliminates solvent condensation problems on the chill rolls, reduces chilled water use at the chill stand, has less sensitivity to dryer/printing press process variations, and has lower dryer operating temperature and associated web exit temperature. It is also believed that with paper webs, the paper gloss is improved and the handling in the folder is improved due to slightly higher residual solvent in the paper web.

Successful operation of the unit requires careful management of the cooling fluid spray. It is important to monitor the web temperature and use that temperature measurement to limit the amount of spray. Excess spray is not desired as it can migrate into the upper part of the hood and reduce the life of the charge bars. In addition, extra mist can pressurize the unit and leak out the web slot and condense on chill rolls and other surfaces. This mist may also contain solvent vapor which forms deposits on the surfaces it condenses on.

DETAILED DESCRIPTION OF THE INVENTION

Figure 1:
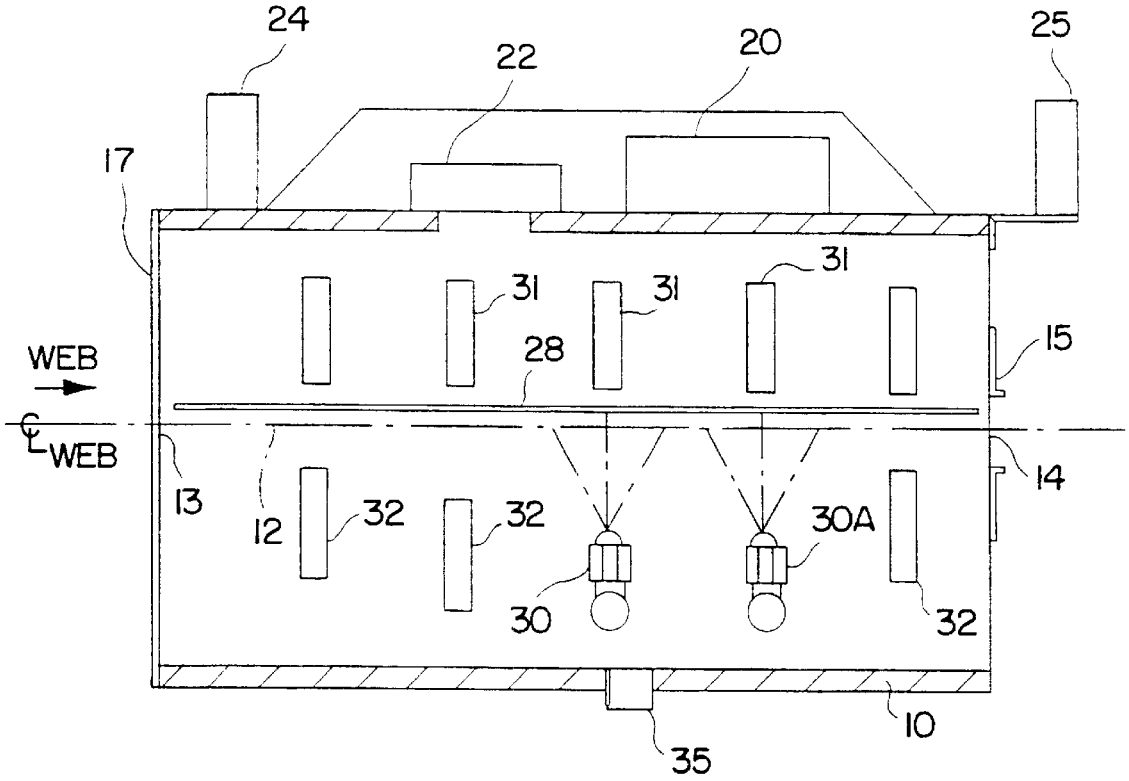
FIG. 1 is a schematic view of one embodiment of the apparatus in accordance with the present invention.
Figure 3:
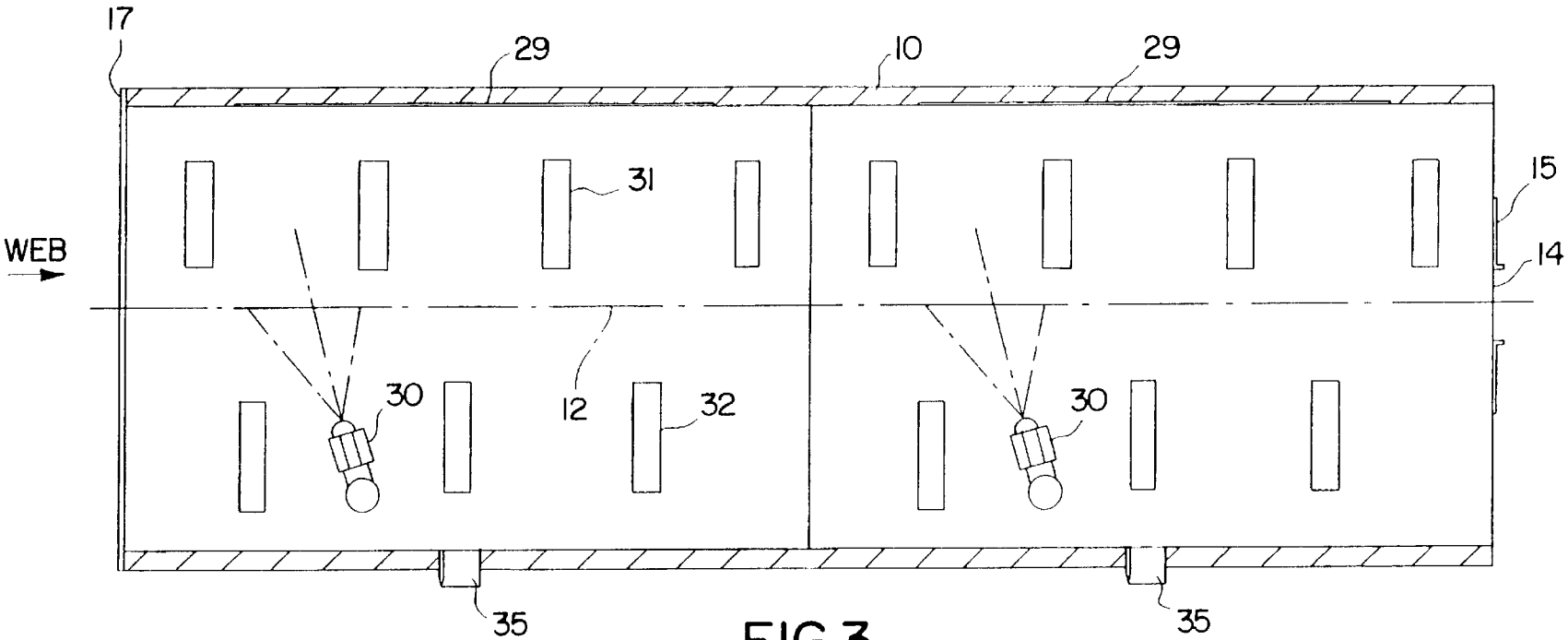
FIG. 3 is a schematic view of the apparatus in modular form in accordance with one embodiment of the present invention.

Turning first to FIG. 1, there is shown a running web entering a housing 10 through a first web slot 13 and exiting the housing 10 through a second web slot 14 spaced from the first web slot and horizontally aligned therewith. A web slot seal 15 can be used to minimize the transfer of gases (air) between the housing 10 and outside the housing 10. Preferably the housing 10 is thermally insulated, and also includes an electrical insulator 17 between the metal cladding of the dryer end frame and the housing 10 to prevent an unwanted ground path for charge bars 31. The web 12 enters the housing 10 after having exited a web flotation dryer (FIG. 4) attached to the housing 10, passes through the housing 10, and exits the housing 10 and continues to cooling apparatus (not shown), for example, such as a chill stand. Preferably the housing 10 is dimensioned such that it can replace an existing smoke tunnel and thus be retrofitted into an existing dryer upon removal of the smoke tunnel which is rendered obsolete by the present invention. Housing having lengths of from 20 to 40 inches are generally suitable for this purpose. The cooling device is also capable of modular design, allowing two or more modules to be aligned in series as shown in FIG. 3. This optimizes spacing of the charge bars and spray nozzles to minimize cost and maximize spray effectiveness. As faster web speeds and heavier web weights are encountered, additional modules can be added. The cross-web dimensions of the device will vary with web width. Top and bottom access to the internal components in the housing 10 is provided.

The design of the web flotation dryer can be conventional, and preferably includes a plurality of upper and lower Coanda air bars to floatingly dry the running web 12, thereby raising its temperature.

In a preferred embodiment of the present invention, integrated into the housing 10 is a power supply 20. By integrating the power supply to the housing 10, significant advantages are realized compared to a device having a remote power supply. Since high voltage (30–50 kV) is required to operate the apparatus, ease of connecting high voltage to the charge bars and of supplying residual heat to the enclosure via a fan 22 to prevent any solvent condensation from occurring is achieved. This is in contrast to expensive high voltage connectors or custom fit wiring on-site where the power supply is remotely located.

At least one row of spray nozzles 30 are provided, which receive water (or other suitable cooling fluid, such silicone and/or other surfactants or fluids which contain silicone or other surfactants) from a source, such as a reservoir (not shown), and spray the fluid towards the web 12. A water softener device may be used for the water supply to prevent scale buildup from plugging the nozzles. Preferably the spray nozzles 30 are an axial flow hollow cone type with 0.15 mm orifice diameters, and are spaced 2 inches between nozzle centers. The amount an rate of fluid sprayed from the spray nozzles 30 can be controlled to achieve a desired cooling rate. A web temperature sensor 24, preferably located at or near the exit end of the housing, allows the web cooling to be monitored and maintained at a desired (e.g., predetermined) setpoint by adjusting pump pressure and flow of fluid to the spray nozzles 30. More specifically, a web temperature setpoint is selected and the fluid spray pressure is increased until the temperature is reached or the pump output is at a maximum. A controller can be used to increase the pump speed which is controlled by a variable speed drive. Thus, a closed loop pump output control system using the temperature sensor can be provided to optimize web cooling. A second web temperature sensor 25 spaced from the sensor 24 also can be used; the preferred arrangement locating one sensor at the web inlet and the second at the web outlet. In the two sensor embodiment, a differential setpoint between inlet and outlet temperatures, for example, can be used. A suitable differential setpoint between inlet and outlet temperatures is 40 to 50°, for example.

Figure 7:
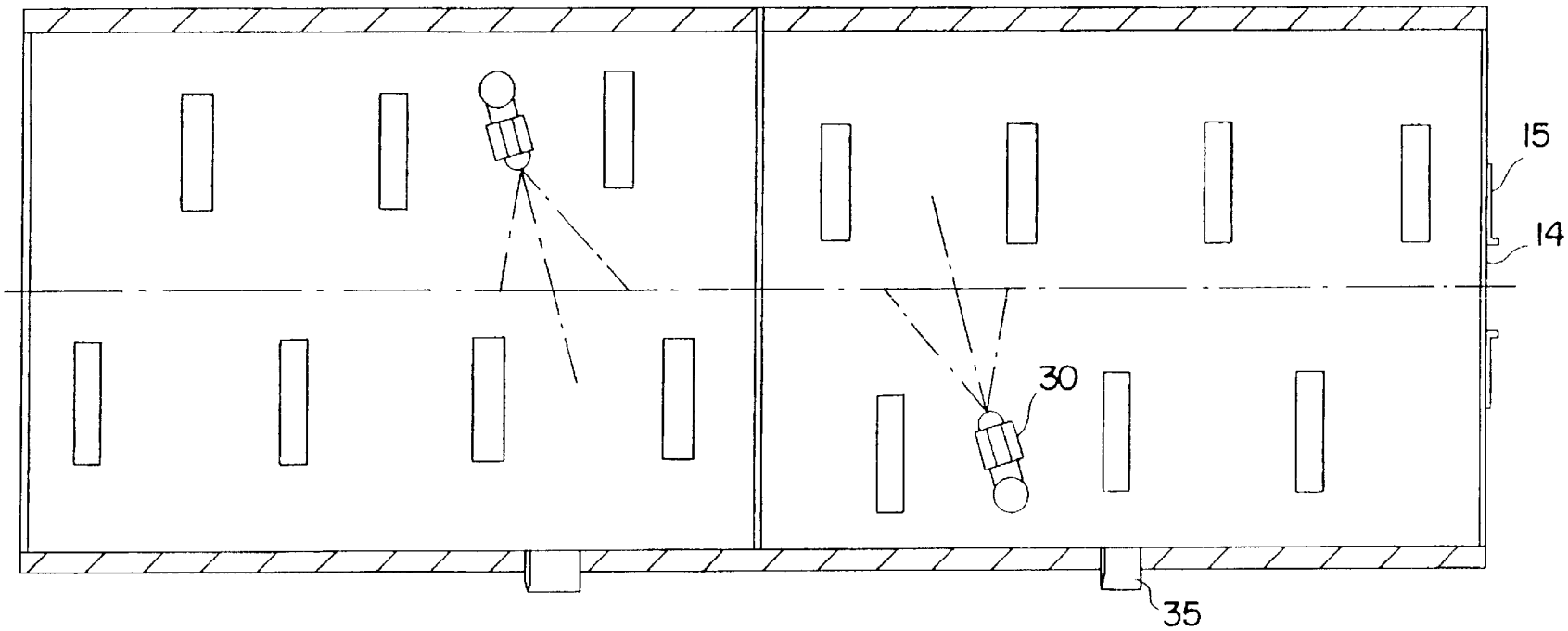
FIG. 7 is a schematic view of the apparatus in modular form in accordance with another embodiment of the present invention.

A second row of spray nozzles 30A can be provided to increase the cooling capacity of the apparatus where necessary or desirable. Suitable valving may be used to allow the fluid flow to one or more individual nozzles 30, 30A to be interrupted, especially where a ¾ or ½ width web is run rather than a full web width, as less fluid will be wasted if the unneeded nozzles are shut down, and the overhead charge devices will be protected from the direct fluid spray (excessive water spray on the charge devices can cause them to short out). Water spray also may be applied on both sides of the web, such as to reduce smoking from the web by quickly ending the solvent evaporation process. This feature is shown in FIG. 7, which is similar to FIGS. 1 and 3 except with the provision for water spray nozzles 30 on the top of the web as well as the bottom.

A plurality of electrostatic charge generators or bars 31 are provided in the housing 10 above one side of the web 12, which generate an electric charge or electrostatic field within the housing 10. A plurality of field director or ground bars 32 are provided in the housing 10 on the opposite side of the web 12 to direct the fluid droplets exiting the spray nozzles 30 toward the web 12. Preferably ground bar 32 is located opposite a charge bar 31. The combination of the electrostatic charge generators 31 and field directors 32 limits the flow path of the droplets exiting the spray nozzles, ensuring that most or all of the droplets impinge upon the web 12. The electrostatic charge on the web 12 created by the bars 31 attracts the spray and causes the droplets to break down into extremely small particles. These two actions allow a very high percentage (80–95%) of the spray to be used in cooling the web 12. Because the process uses the latent heat of vaporization of water, efficient cooling of the web is achieved relative to its temperature when exiting the dryer.

Figure 8:
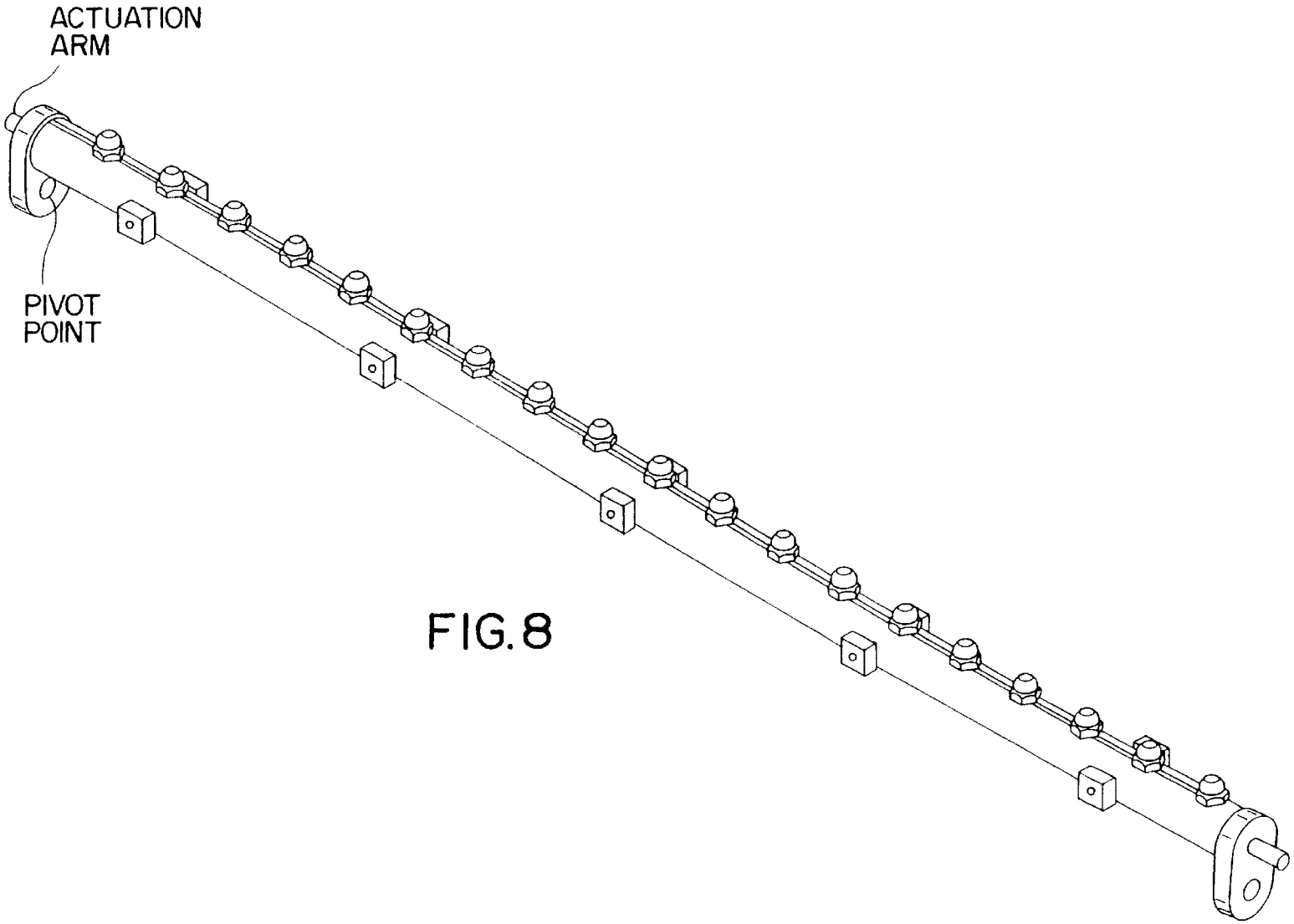
FIG. 8 is a perspective view of a spray nozzle manifold in accordance with one embodiment of the present invention.
Figure 9:
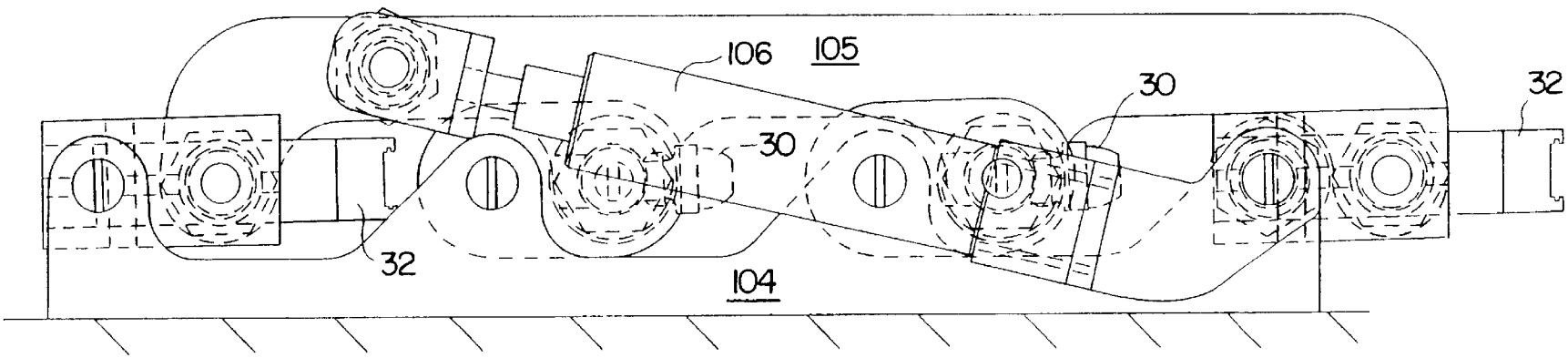
FIG. 9 is a side view of the retractable manifold arrangement shown in the retracted position in accordance with one embodiment of the present invention.
Figure 10:
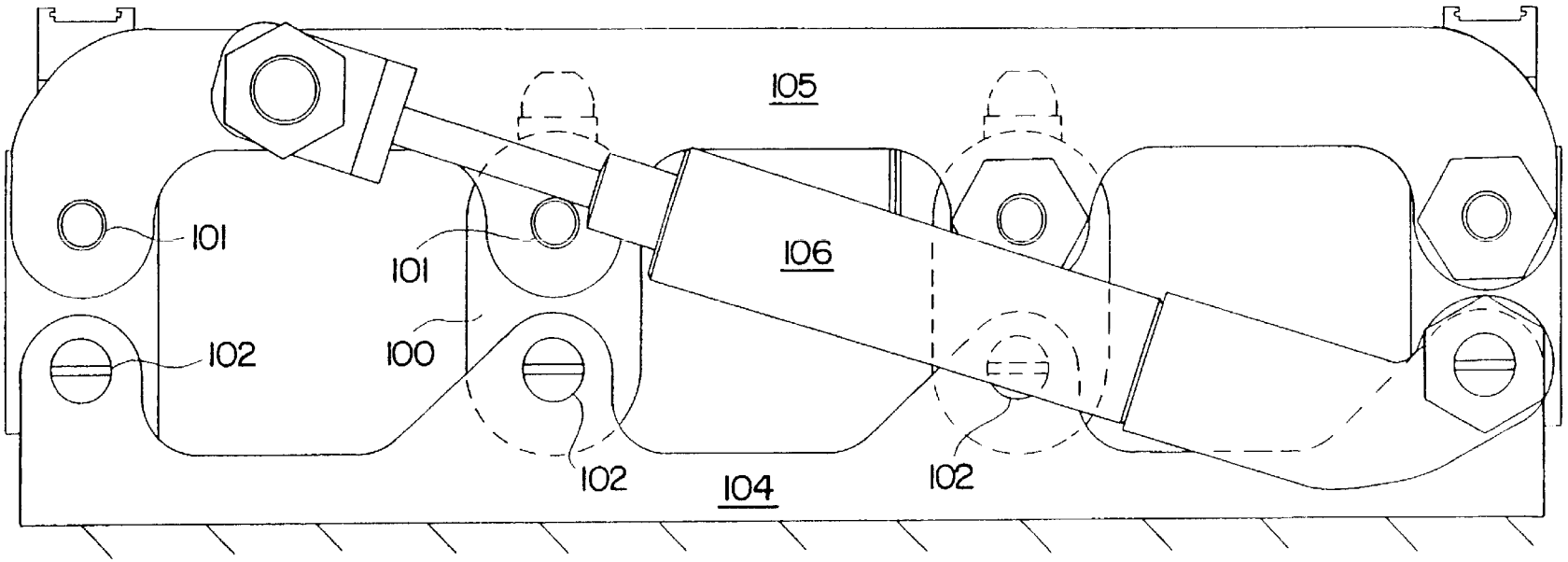
FIG. 10 is a side view of the retractable manifold arrangement shown in the unretracted position in accordance with one embodiment of the present invention.
Figure 11:
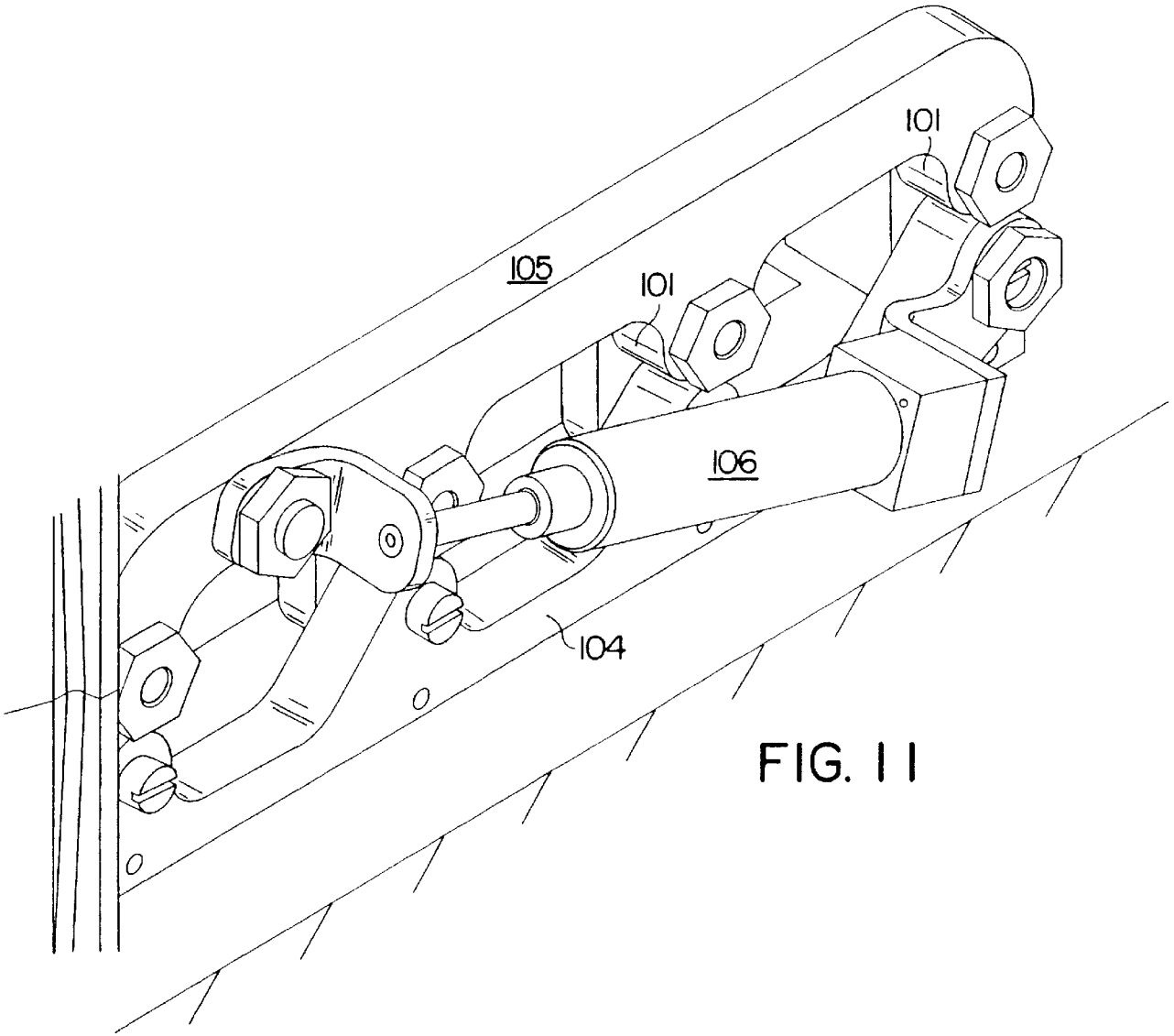
FIG. 11 is a perspective view of the retractable manifold in accordance with one embodiment of the present invention.

It is an advantage when "webbing up" the device not to have protrusions which the web can catch on and cause the web to break. In order to aid the web up process, the nozzles and bars can be retractable. FIG. 8 shows a spray nozzle manifold 100 having a plurality of nozzles 30 and provisions for retraction. The nozzles 30 are preferably linearly aligned along each manifold 100 in the direction across the width of the web. The opposite ends of the manifold 100 each include an actuation arm 101 and a pivot point 102. Similar manifolds can be used for each linear array of ground bars 32 which are also located below the web line in the cooling assembly. Multiple nozzles and bars are tied together at the pivot points 102 with a common bar 104. The actuating arms 102 of each device are tied together with a second common bar 105. An actuating device such as a pneumatic cylinder 106 can be used to automatically retract the devices together. As shown in FIG. 11, one end of the cylinder 106 is coupled to the common bar 104, and the opposite end is coupled to the common bar 105. Alternatively, each manifold can be actuated independently. The nozzles and bars are shown in the retracted position in FIG. 9, in which they are retracted 900 from their operable position, and in the unretracted position in FIG. 10.

Any excess fluid is removed through a drain 35, and also by small amount of exhaust air (e.g., 100 scfm/ft of web width). The exhaust air also removes the steam generated by the evaporation of the water mist (typically web temperatures encountered as the web exits the dryer heating section are froma about 260° F. to about 320° F., which is hot enough to cause the mist to become steam). Without adequate exhaust, the unit will pressurize and send mist out the web slot. The mist may contain solvent vapor which can condense on surfaces such as chill rolls and contaminate them. The fluid supply line can include a valve which can be opened in the event of a web break, or in order to prevent spray from spraying on a stationary web (a wet web can easily break when web tension is reapplied). The exhaust air may be supplied by a fan 22 or by the normal flow of air through the web slot into a negatively pressurized enclosure. An optional heater 29 (FIG. 3) can be used to raise the temperature of the atmosphere within the housing 10.

Figure 12:
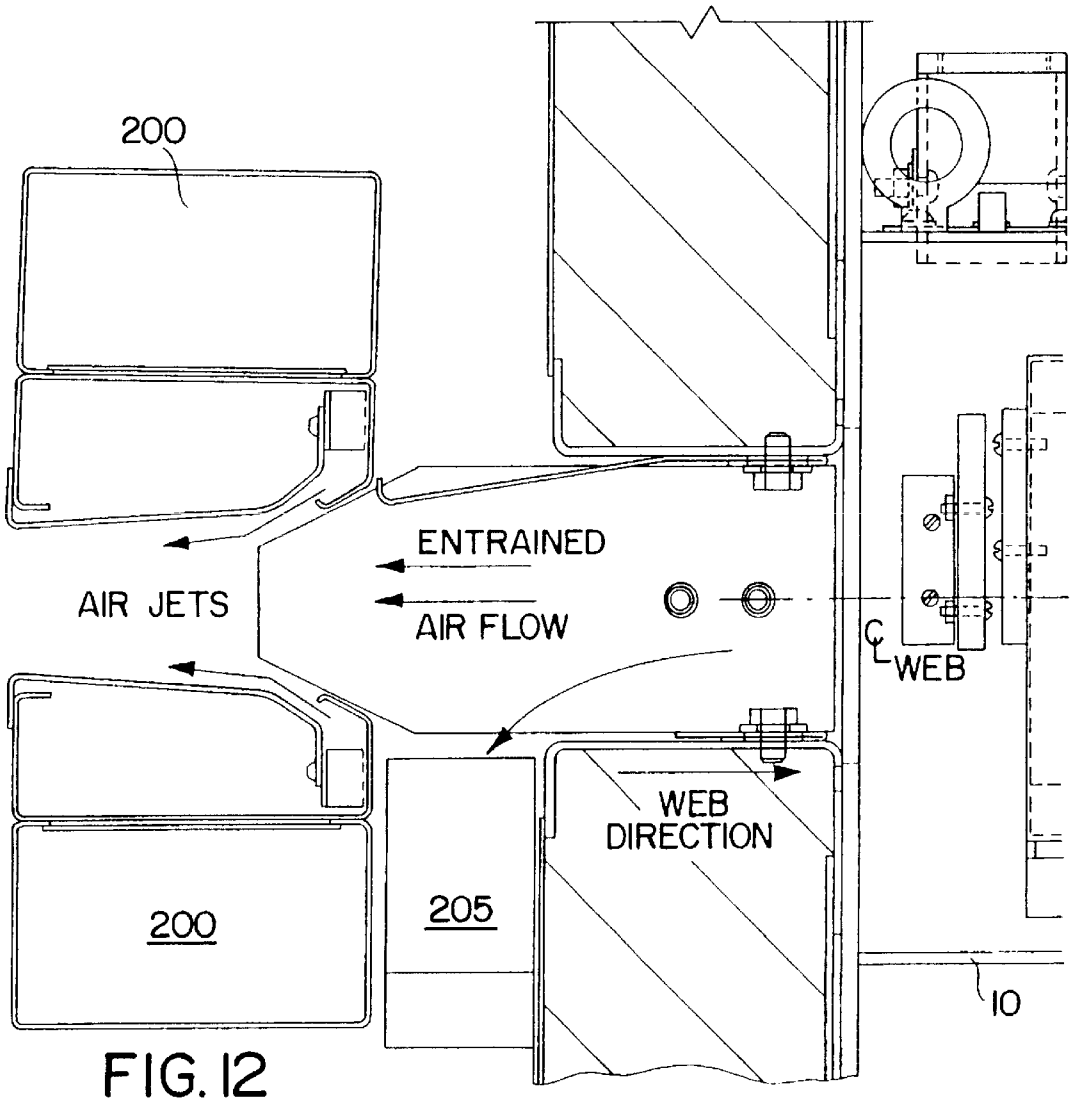
FIG. 12 is a cross-sectional view of the entrained air flow in accordance with one embodiment of the present invention.

A preferred method of exhausting air is to pressurize the top half of the enclosure with the fan 22. This removes excessive moisture from the area surrounding the charge devices which may be harmful to them. The air can then travel into the attached dryer, or be exhausted by independent means. One embodiment of exhausting air in the present invention is illustrated in FIG. 12, which is particularly applicable for dryers with low negative pressure at the web slot. A pair of opposite seal bars 200 are positioned at the web slot to produce air jets. The air jets entrain surrounding air and cause the air to flwo into the dryer through the web slot. The shape of the bars encourages the jet to adhere to the bar surface and not disturb the web. An optional suction box 205 which is ducted to the supply or exhaust fan inlet can be used to produce a greater pressure differential at the web slot.

Figure 2:
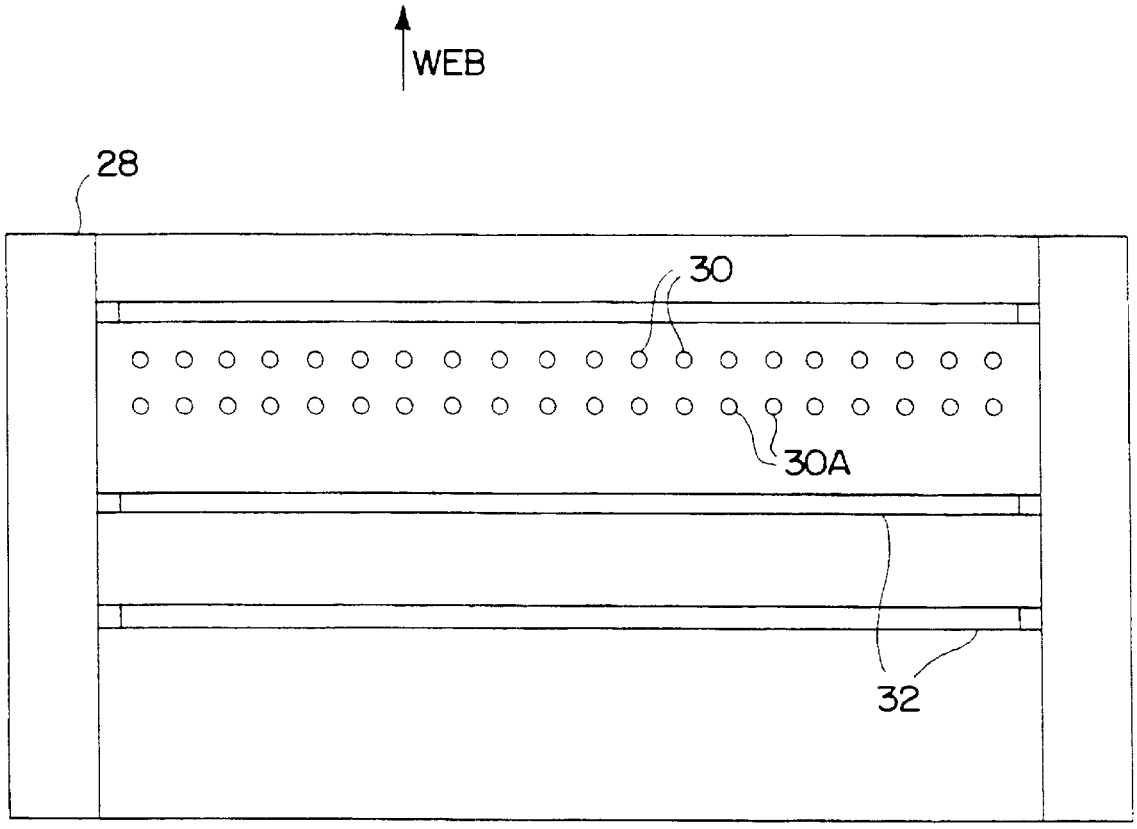
FIG. 2 is a section view of the apparatus of FIG. 1 in accordance with the present invention.

FIG. 2 shows a section view of the apparatus. An edge seal 28 is provided to establish the proper electrostatic charge on the web 12. In the embodiment shown, two rows of nozzles 30, 30A are used, spaced at 2 inch centers, with five electrostatic charge bars (not shown) and three field director bars 32. The preferred operating pressure range of the device is 400 to 1000 psig, with a maximum water flow rate for a device having 20 nozzles of about 0.3 gallons per minute at 1000 psig.

Figure 4:
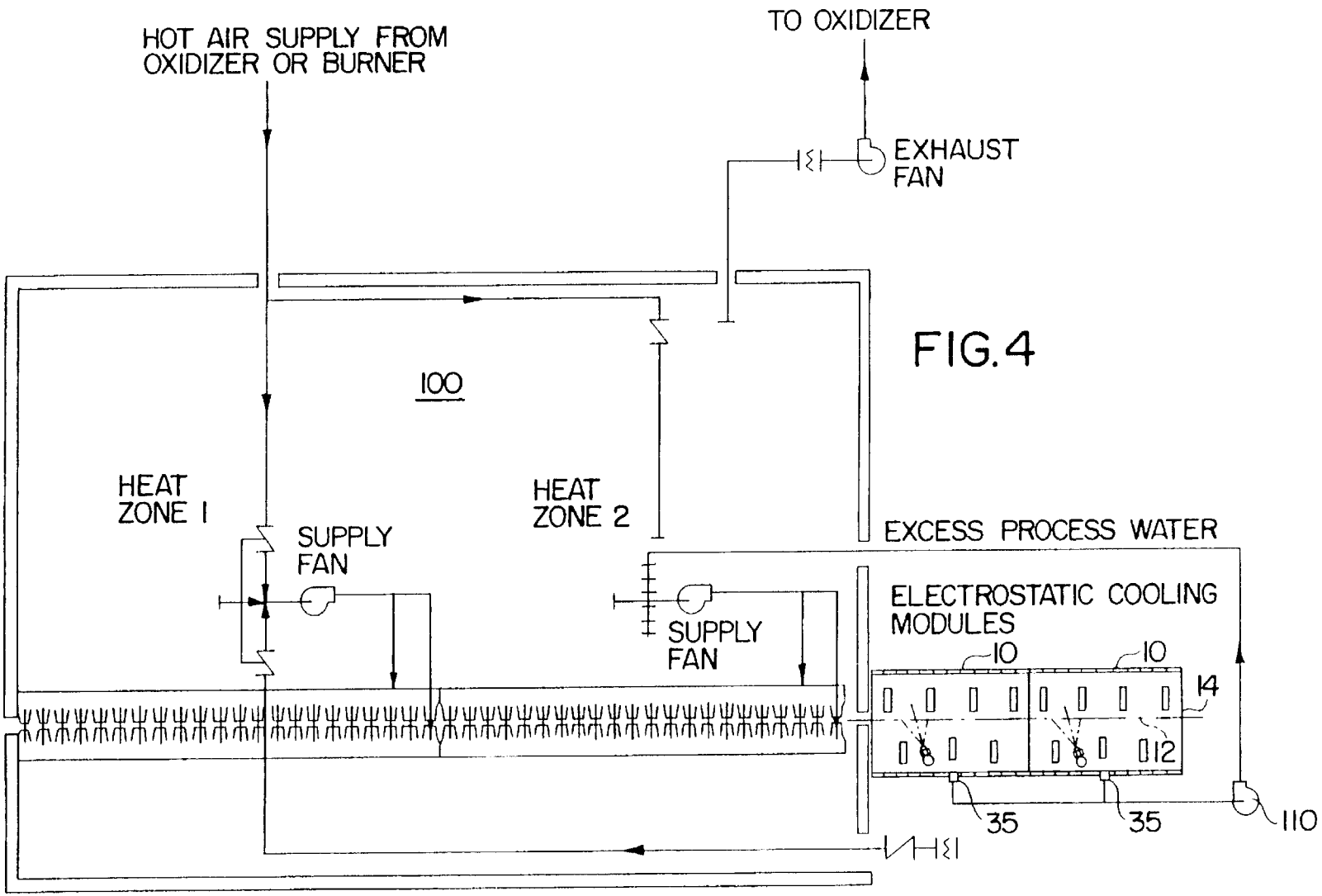
FIG. 4 is a schematic view of a web flotation dryer with an electrostatic cooling apparatus in accordance with the present invention.
Figure 5:
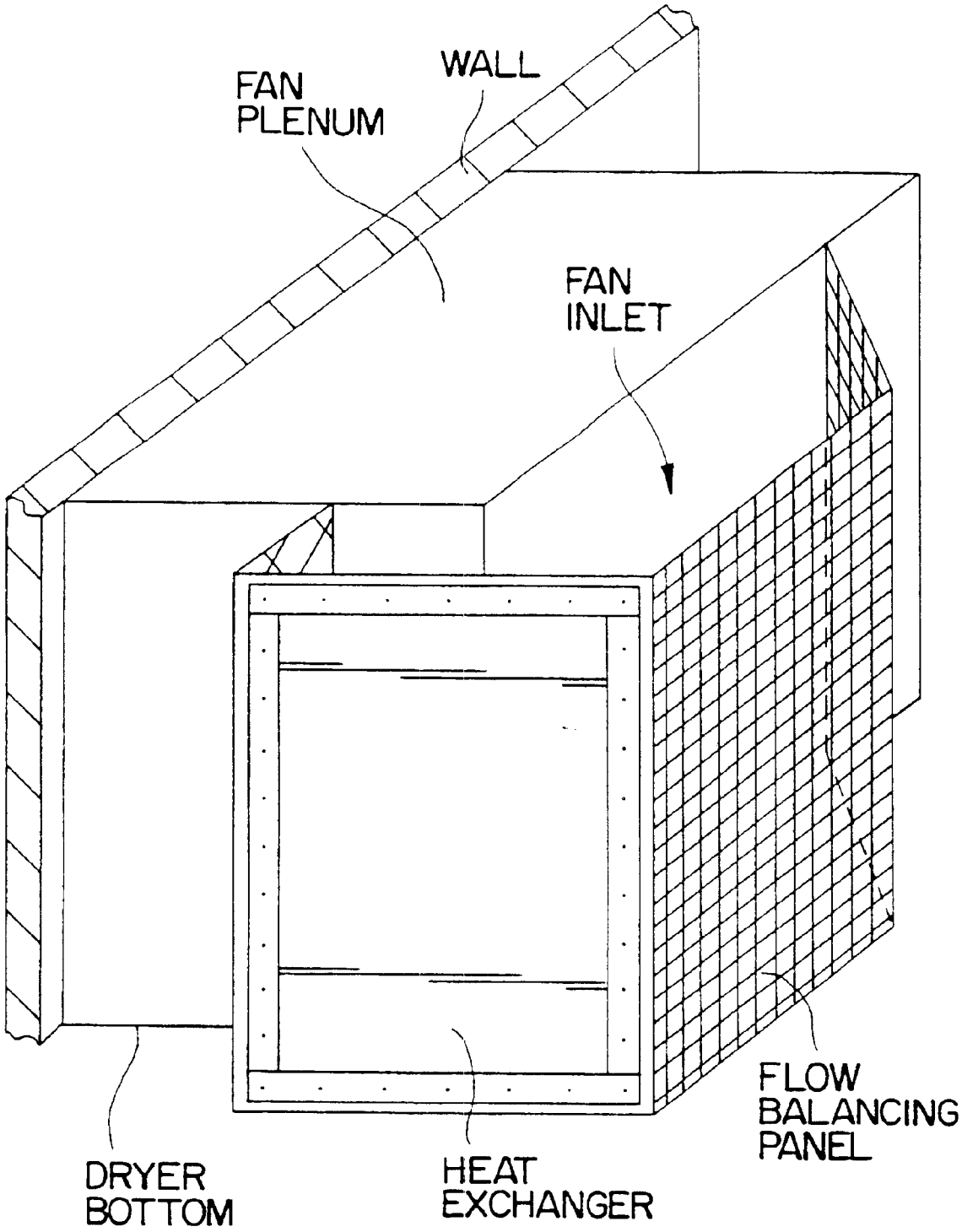
FIG. 5 is a perspective view of the fan inlet modification for evaporating excess water generated in the electrostatic cooling device in accordance with the present invention.

FIGS. 4 and 5 illustrate a two-module electrostatic cooling device in communication with and adjacent to a web flotation dryer 100 utilizing evaporation to evaporate the excess water generated in the cooling device. In the embodiment shown, excess water exiting drains 35 of each module is directed into a dryer 100 by a suitable driving means such as a pump 110 and associated piping. FIG. 5 shows mounting details of the optional evaporating device on the fan inlet, which is the preferred arrangement for this feature. However, the evaporating device also can be mounted on the fan outlet. Excess water removed from the housing also can be filtered and directed back to the water spray nozzles, or can be used for other purposes such as as make-up water for an offset printing press dampening water system.

Figure 6:
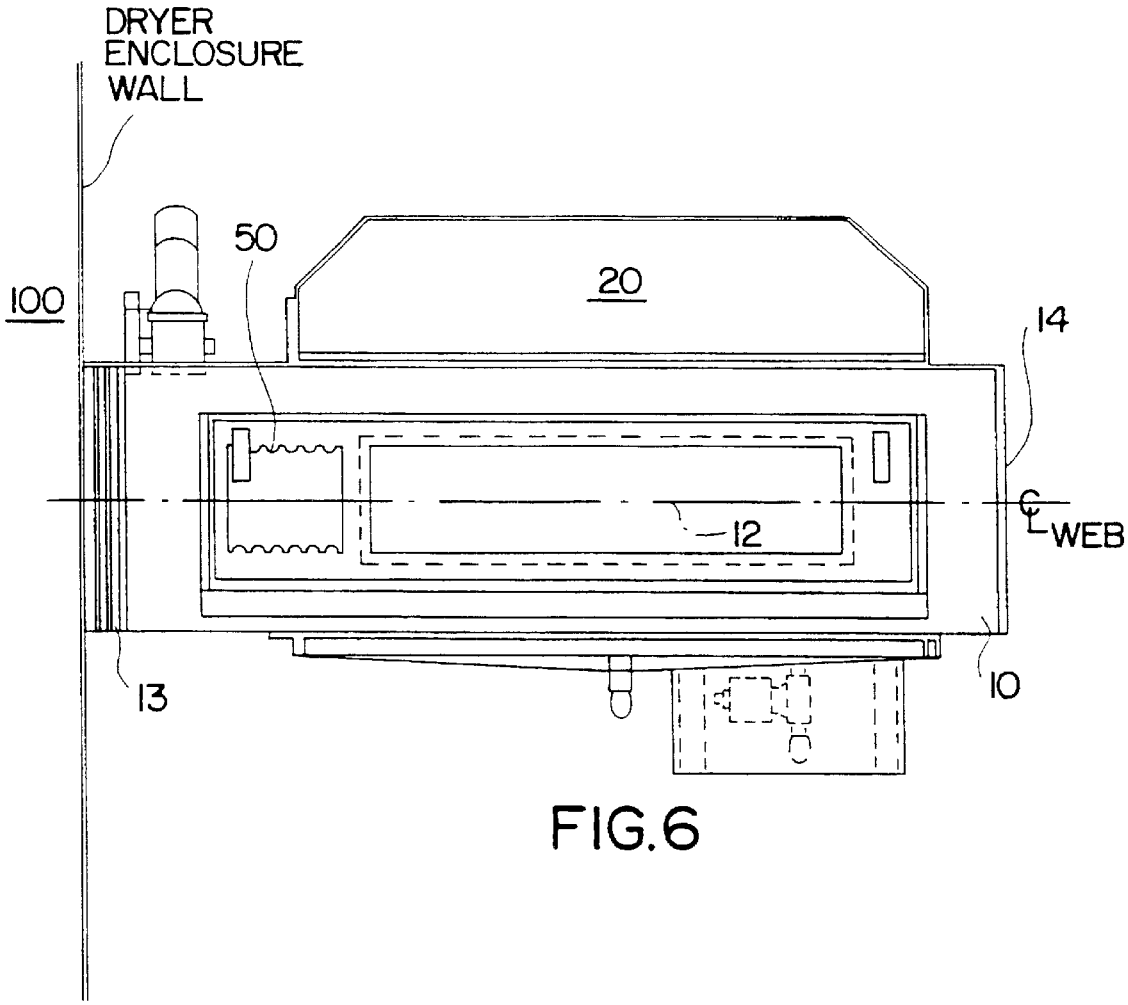
FIG. 6 is a schematic view of an alternative embodiment of the present invention.

FIG. 6 shows another embodiment of the present invention where the management of infiltration air is carried out. The housing 10 is shown attached to dryer 100, with a traveling web 12 entering the housing 10 from the dryer 100 exit through a web slot 13 the size of which may be adjustable. By adjusting the opening of the web slot 13, the amount of air that flows back into dryer 100 from the housing 10 due to the negative pressure maintained in the dryer 100 can be controlled. Alternatively or in addition, a perforated plate 50 can be used to allow air to flow into the housing 10, which air is then also directed into the dryer enclosure 100 due to the negative pressure in the dryer 100. Since air entering the housing 10 through the web exit slot 14 can disturb the spray being applied to the web 12, management of infiltration air such as by the use of an adjustable web slot or perforated plate can minimize or eliminate the flow of air into the housing 10 through the web slot 14, thereby minimizing any disturbance of the spray.

What is claimed is:

1. Apparatus for drying and cooling a running web, comprising a dryer for said web having a dryer web inlet and a dryer web outlet spaced from said inlet; a housing in communication with said dryer and having a housing web inlet and a housing web outlet spaced from said web inlet, a plurality of spray nozzles in said housing for spraying a fluid onto said web; a plurality of electrostatic charge elements in said housing for generating an electrostatic charge on said web; a plurality of field director elements in said housing for directing said fluid sprayed from said plurality of spray nozzles towards said web; a drain for removing excess fluid from said housing; a temperature sensor for sensing the web temperature in said housing and controlling the amount of fluid emitted by said spray nozzles based upon the sensed temperature; and exhaust means for exhausting from said housing excess mist or steam generated by said spray nozzles.

2. The apparatus of claim 1, further comprising a power supply integrated with said housing for supplying power to said electrostatic charge elements.

3. The apparatus of claim 1, wherein said exhaust means directs said excess mist or steam into said dryer.

4. The apparatus of claim 1, wherein said exhaust means comprises opposed seal bars for generating air jets towards said dryer.

5. The apparatus of claim 4, wherein said exhaust means further comprises means for increasing the pressure differential between said housing and said dryer.

6. The apparatus of claim 1, wherein said web temperature is sensed at said housing web outlet.

7. The apparatus of claim 1, wherein the controlling of said fluid is accomplished with a variable speed pump.

8. The apparatus of claim 1, wherein said plurality of spray nozzles are retractable with respect to said web.

9. The apparatus of claim 1, wherein said plurality of said field director elements are retractable with respect to said web.

10. A method for drying and cooling a running web of material, comprising:

drying said running web in a dryer;

causing said web to exit said dryer and enter a housing;

generating an electrostatic field in said housing;

causing said web to pass through said electrostatic field in said housing;

providing spraying means for spraying a fluid through said electrostatic field onto said web;

sensing the temperature of said web in said housing;

controlling the amount of fluid sprayed onto said web by said spraying means based upon said sensed temperature.

11. The method of claim 10, further comprising collecting any excess fluid in said housing and removing it from said housing.

12. The method of claim 11, wherein said excess fluid is evaporated after being removed from said housing.

13. The method of claim 10, wherein said housing has a web inlet and a web outlet, said method further comprising minimizing the flow of air into said housing through said web outlet.

14. The method of claim 10, further comprising exhausting excess mist or steam generated by said sprayed fluid from said housing.

* * * * *